US010961601B2

(12) United States Patent
Ono et al.

(10) Patent No.: US 10,961,601 B2
(45) Date of Patent: Mar. 30, 2021

(54) STEEL SHEET AND PLATED STEEL SHEET, METHOD FOR PRODUCING HOT-ROLLED STEEL SHEET, METHOD FOR PRODUCING COLD-ROLLED FULL-HARD STEEL SHEET, METHOD FOR PRODUCING STEEL SHEET, AND METHOD FOR PRODUCING PLATED STEEL SHEET

(71) Applicant: JFE Steel Corporation, Tokyo (JP)

(72) Inventors: Yoshihiko Ono, Tokyo (JP); Yoshimasa Funakawa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 337 days.

(21) Appl. No.: 16/089,162

(22) PCT Filed: Jan. 23, 2017

(86) PCT No.: PCT/JP2017/002042
§ 371 (c)(1),
(2) Date: Sep. 27, 2018

(87) PCT Pub. No.: WO2017/168991
PCT Pub. Date: Oct. 5, 2017

(65) Prior Publication Data

US 2020/0299798 A1 Sep. 24, 2020

(30) Foreign Application Priority Data

Mar. 31, 2016 (JP) ..... JP2016-070753

(51) Int. Cl.
*C21D 9/46* (2006.01)
*C22C 38/02* (2006.01)
(Continued)

(52) U.S. Cl.
CPC ..... *C21D 9/46* (2013.01); *C21D 6/004* (2013.01); *C21D 6/005* (2013.01); *C21D 6/008* (2013.01);
(Continued)

(58) Field of Classification Search
None
See application file for complete search history.

(56) References Cited

FOREIGN PATENT DOCUMENTS

JP 0441658 A 2/1992
JP 2004137565 A 5/2004
(Continued)

OTHER PUBLICATIONS

English language machine translation of WO-2013160928-A1 to Okuda. Generated Oct. 27, 2020. (Year: 2020).*
(Continued)

*Primary Examiner* — Brian D Walck
(74) *Attorney, Agent, or Firm* — RatnerPrestia

(57) ABSTRACT

A steel sheet has a composition comprising, in mass %, C: 0.0008 to 0.0024%, Si: less than 0.15%, Mn: more than 0.55% and less than 0.90%, P: more than 0.025% and less than 0.050%, S: 0.015% or less, sol. Al: 0.01% or more and 0.1% or less, N: 0.01% or less, B: more than 0.0003% and less than 0.0035%, Nb: more than 0.005% and less than 0.016%, Ti: 0.009% or less, and Sb: 0.002 to 0.030%, in which C and Nb satisfy the following formula (1), and the balance is Fe and unavoidable impurities, and in which a ds/d ratio of an average crystal grain diameter, at a ¼ thickness position of the sheet (d), to that at a steel sheet surface layer (ds), is 0.40 to 1.20, where d is 8 to 18 μm, and where $$-10 \leq ([\%\ C]-([\%\ Nb]/93)\times 12)\times 10{,}000 \leq 14. \quad \text{Formula (1)}$$

12 Claims, 1 Drawing Sheet

(51) Int. Cl.

| | |
|---|---|
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/16*** | (2006.01) |
| ***C22C 38/42*** | (2006.01) |
| ***C22C 38/48*** | (2006.01) |
| ***C22C 38/50*** | (2006.01) |
| ***C22C 38/54*** | (2006.01) |
| ***C22C 38/60*** | (2006.01) |
| ***C21D 6/00*** | (2006.01) |
| ***C21D 8/02*** | (2006.01) |
| ***C22C 38/00*** | (2006.01) |

(52) U.S. Cl.

CPC ..... *C21D 8/0205* (2013.01); *C21D 8/0226* (2013.01); *C21D 8/0236* (2013.01); *C21D 8/0273* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01); *C22C 38/42* (2013.01); *C22C 38/48* (2013.01); *C22C 38/50* (2013.01); *C22C 38/54* (2013.01); *C22C 38/60* (2013.01)

(56) References Cited

FOREIGN PATENT DOCUMENTS

| | | | | |
|---|---|---|---|---|
| JP | 2004263238 | A | 9/2004 | |
| JP | 2007092134 | A | 4/2007 | |
| JP | 2007254766 | A | 10/2007 | |
| JP | 2008274360 | A | 11/2008 | |
| JP | 2009518541 | A | 5/2009 | |
| JP | 2010196096 | A | 9/2010 | |
| JP | 2011246767 | A | 12/2011 | |
| JP | 2013064169 | A | 4/2013 | |
| JP | 2013072107 | A | 4/2013 | |
| JP | 2013185240 | A | 9/2013 | |
| JP | 2014043631 | A | 3/2014 | |
| WO | WO-2013160928 | A1 * | 10/2013 | ..... C22C 38/001 |

OTHER PUBLICATIONS

International Search Report and Written Opinion for International Application No. PCT/JP2017/002042, dated Apr. 25, 2017—5 pages.

* cited by examiner

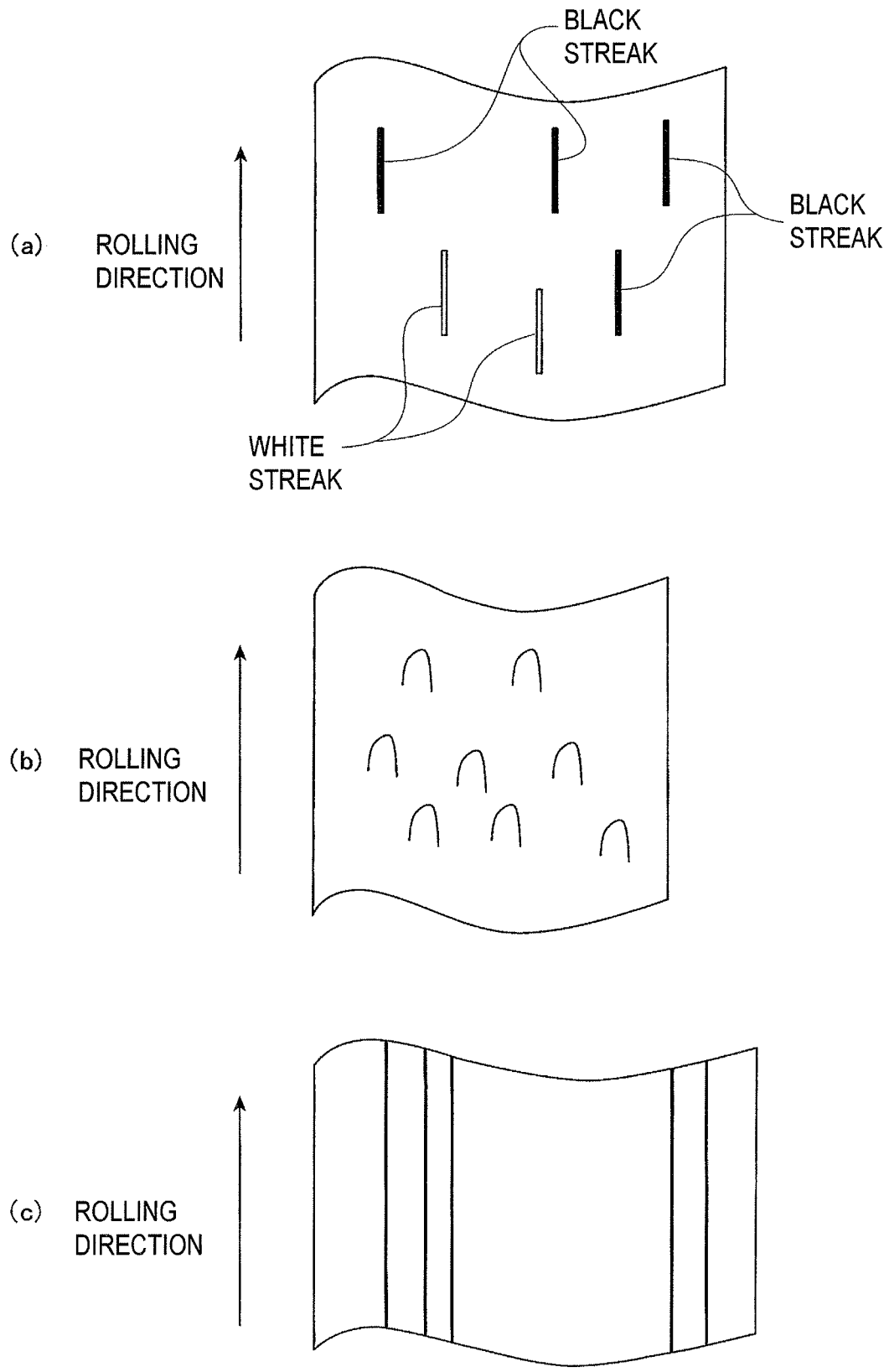
BLACK STREAK
BLACK STREAK
(a) ROLLING DIRECTION
WHITE STREAK
(b) ROLLING DIRECTION
(c) ROLLING DIRECTION

STEEL SHEET AND PLATED STEEL SHEET, METHOD FOR PRODUCING HOT-ROLLED STEEL SHEET, METHOD FOR PRODUCING COLD-ROLLED FULL-HARD STEEL SHEET, METHOD FOR PRODUCING STEEL SHEET, AND METHOD FOR PRODUCING PLATED STEEL SHEET

CROSS REFERENCE TO RELATED APPLICATIONS

This is the U.S. National Phase application of PCT/JP2017/002042, filed Jan. 23, 2017, which claims priority to Japanese Patent Application No. 2016-070753, filed Mar. 31, 2016, the disclosures of each of these applications being incorporated herein by reference in their entireties for all purposes.

FIELD OF THE INVENTION

The present invention relates to a steel sheet and a plated steel sheet, and to a method for producing a hot-rolled steel sheet, a method for producing cold-rolled full-hard steel sheet, a method for producing a steel sheet, and a method for producing a plated steel sheet.

BACKGROUND OF THE INVENTION

The panel components of an automobile, including a hood, doors, and a backdoor require high dent resistance, and a BH steel sheet having a tensile strength (TS) on the order of 340 MPa (bake-hardenable steel sheet; hereinafter, simply "340BH") is in wide use for this purpose. These components also need to meet various design and cosmetic requirements of automobiles while satisfying high bake hardenability (hereinafter also referred to as "BH characteristic") and high aging resistance. The 340BH steel sheet therefore requires desirable formability and a cosmetically appealing surface quality, in addition to high bake hardenability and high aging resistance.

However, traditional 340BH steel sheets involve press cracking in heavily stretched portions such as in areas around the tail lamp of a backdoor, and further improvement is needed for ductility. In many of traditional 340BH steel sheets containing Mn, P, and Ti, surface undulations (defects) called line patterns or ghost bands often occur after pressing, and there is a need to improve surface quality.

In this connection, for example, PTL 1 discloses a technique for providing a steel sheet on the order of 340 MPa having a uniform elongation of 18% or more with a high bake hardenability. In order to obtain such a steel sheet, the heating rate in the annealing process of a steel to a temperature in the range of 550° C. to soaking temperature is adjusted to 0.1×([% Nb]/[% C])° C./s or more, containing C: 0.0010 to 0.0040%, Si: 0.05% or less, Mn: 0.1 to 1.0%, and Nb: 0.005 to 0.025%, and satisfying [% Nb]/[% C]≤10, and [% Mn]/[% C]≥100.

PTL 2 discloses a method for providing a bake-hardenable high-strength alloyed hot-dip galvanized steel sheet having excellent powdering resistance. This steel sheet is produced from a steel sheet containing C: 0.010% or less, Si: 0.5% or less, Mn: 0.15 to 0.8%, P: 0.030% or less, S: 0.03% or less, B: 0.0005 to 0.0050%, and Nb: 2×C (%) to 7.5×C (%), and at least one of Sn: 0.05 to 0.80%, Sb: 0.005 to 0.080%, and Cr: 0.020 to 1.5% is added, and reduced phosphorus that promotes coating detachment, with Sn, Sb, and Cr for adding strength.

PTL 3 discloses a technique for reducing nonuniform alloying of a coating by way of reducing the phosphorus that causes streak patterns. This is achieved by low-temperature annealing of a steel sheet containing C: 0.003% or less, Si: 0.1% or less, Mn: 0.20 to 1.0%, P: 0.01 to 0.03%, and Nb: 2×[% C]+0.01 to 8×[% C]+0.01(%).

PATENT LITERATURE

PTL 1: JP-A-2013-64169
PTL 2: JP-A-4-41658
PTL 3: JP-A-2004-263238

SUMMARY OF THE INVENTION

However, the technique described in PTL 1 is insufficient in terms of ductility improvement for improved formability, and needs further improvements. Further improvement is also needed for surface quality.

The technique described in PTL 2 is problematic because it causes deterioration of toughness after deep drawing (resistance to brittleness for secondary working) when Sn and Sb are added in amounts large enough for solid solution strengthening. This makes it difficult to use the steel sheet of PTL 2 for practical applications. PTL 2 does not disclose a technique for improving ductility.

The technique described in PTL 3 is also silent as to ductility improvement.

As discussed above, none of the techniques of the related art disclose a technique that provides excellent ductility and excellent surface quality while maintaining high bake hardenability and high aging resistance. The present invention has been made under these circumstances, and it is an object of the present invention to provide a steel sheet having a tensile strength on the order of 340 MPa, and that exhibits excellent ductility and excellent surface quality while satisfying desirable bake hardenability and aging resistance. The present invention is also intended to provide a method for producing such a steel sheet. Another object of the present invention is to provide a plated steel sheet produced by plating the steel sheet, a method for producing a hot-rolled steel sheet needed to obtain the steel sheet, a method for producing a cold-rolled full-hard steel sheet needed to obtain the steel sheet, and a method for producing a plated steel sheet.

The present inventors conducted intensive studies of techniques based on traditional 340BH, in order to improve both ductility and surface quality while maintaining desirable aging resistance. The studies led to the following conclusions.

(I) Having the same total elongation (El) does not always mean that stretch formability is the same. This is because uniform elongation (U.El) is not necessarily the same for the same El. Steels having high stretch formability have high U.El. That is, formability improves with increase of U.El, which is an elongation index that directly affects stretch formability. U.El improves when fine ferrite grains are present with reduced C and Nb contents.

(II) The desirable way to improve U.El by means of fine crystal grains is to generate fine ferrite in a Mn-rich steel by quenching the steel to a predetermined temperature region on a runout table with a decreased finishing rolling temperature, followed by low-temperature annealing.

(III) Niobium and boron need to be contained together to stably provide a high BH characteristic and high aging resistance. In such materials, many of the nitrogen atoms that cause deterioration of aging resistance at room temperature become fixed in the form of stable BN, and nitrogen becomes less likely to be consumed as Nb(C,N). This greatly improves the aging resistance at room temperature, and enables use of a 340BH steel sheet also in tropical areas.

(IV) However, the surface quality deteriorates in a Mn-, B-, and Nb-rich steel sheet produced by low-temperature annealing. This is for the following reasons.

Containing Mn, Nb, and B increases the generation of surface scales under the generated heat of hot working, and produces more scale-like patterns.

A boron-containing steel is susceptible to nitridation in surface layer, and the low-temperature annealing delays recrystallization. This causes the unrecrystallized structure and fine ferrite grains to remain in surface layer, and produces more line patterns (ghost bands).

Aside from these problems, a steel sheet containing 0.050% or more of phosphorus as a solid solution strengthening element involves streak or line patterns due to phosphorus segregation. Line patterns also occur in steels containing more than 0.009% of titanium.

These problems can be solved by (a) restricting the Nb, P, and Ti contents, (b) lowering the entry-side temperature and the exit-side temperature of finish rolling in hot rolling, and (c) adding antimony to control the dew point in annealing.

Specifically, a steel sheet that excels in all of formability, aging resistance, and surface quality can be obtained by lowering the entry-side and exit-side temperatures of finish rolling, and lowering the annealing temperature to produce finer crystal grains, and by controlling the dew point in annealing in a Nb-, B-, and Sb-containing steel having controlled Mn, C, Nb, Ti, and P contents.

The present invention has been completed on the basis of these findings, and a gist of exemplary embodiments of the present invention is as follows.

[1] A steel sheet of a composition comprising, in mass %, C: 0.0008 to 0.0024%, Si: less than 0.15%, Mn: more than 0.55% and less than 0.90%, P: more than 0.025% and less than 0.050%, S: 0.015% or less, sol. Al: 0.01% or more and 0.1% or less, N: 0.01% or less, B: more than 0.0003% and less than 0.0035%, Nb: more than 0.005% and less than 0.016%, Ti: 0.009% or less, and Sb: 0.002 to 0.030%, in which C and Nb satisfy the following formula (1), and the balance is Fe and unavoidable impurities, and of a micro structure in which ferrite has an average crystal grain diameter d of 8 to 18 μm at a ¼ thickness position of the sheet, and a ds/d ratio of 0.40 to 1.20, where ds is the average crystal grain diameter of ferrite in a steel sheet surface layer, the steel sheet having a tensile strength of 340 to 380 MPa, a bake hardenability BH of 20 to 60 MPa, and an r value of 1.4 or more, $$-10 \leq ([\%\ C]-([\%\ Nb]/93)\times 12)\times 10{,}000 \leq 14, \qquad \text{Formula (1)}$$

wherein [% C] and [% Nb] represent the C and Nb contents, respectively.

[2] The steel sheet according to item [1], wherein the composition further comprises, in mass %, at least one of V: 0.1% or less, W: 0.1% or less, Zr: 0.03% or less, Mo: 0.15% or less, and Cr: 0.15% or less.

[3] The steel sheet according to item [1] or [2], wherein the composition further comprises, in mass %, at least one of Sn: 0.1% or less, Cu: 0.2% or less, Ni: 0.2% or less, Ca: 0.01% or less, Ce: 0.01% or less, La: 0.01% or less, and Mg: 0.01% or less.

[4] A plated steel sheet comprising a plating layer on a surface of the steel sheet of any one of items [1] to [3].

[5] A method for producing a hot-rolled steel sheet, the method comprising:

heating a steel slab of the composition of any one of items [1] to [3];

hot rolling the steel slab with a cumulative rolling reduction ratio of 50% or more in a temperature region of 1,000° C. or less, a finish rolling entry-side temperature of 1,080° C. or less, and a finish rolling exit-side temperature of more than 850° C. and less than 910° C.;

cooling to 720 to 800° C. at an average cooling rate of 20° C./sec or more;

retaining for 5 seconds or more in the temperature region of 720 to 800° C.; and coiling at a coiling temperature of 580 to 680° C.

[6] A method for producing a cold-rolled full-hard steel sheet, the method comprising cold rolling the hot-rolled steel sheet obtained by the method of item [5], the hot-rolled steel sheet being cold rolled at a rolling reduction ratio of 60 to 95%.

[7] A method for producing a steel sheet, the method comprising:

annealing in which the cold-rolled full-hard steel sheet obtained by the method of item [6] is heated at an average heating rate of 1 to 8° C./sec in a temperature region of 660 to 760° C., and soaked at an annealing temperature of 760° C. to 8300° C. for 30 to 240 seconds with a dew point in a temperature region of 760° C. or more set to −30° C. or less.

[8] A method for producing a plated steel sheet, the method comprising plating the steel sheet obtained by the method of item [7].

The present invention enables production of a steel sheet having excellent formability and surface quality, in addition to exhibiting high bake hardenability, and high room-temperature aging resistance. The invention thus contributes to improving the weight reduction and the appearance of automobile bodies.

The steel sheet according to embodiments of the present invention satisfies a tensile strength of 340 to 380 MPa, a bake hardenability BH of 20 to 60 MPa, and an r value of 1.4 or more.

BRIEF DESCRIPTION OF DRAWINGS

FIG. 1 shows schematic views of typical forms of defects, in which (a) shows defects with streak patterns (black streak, and white streak), (b) shows defects with scale patterns, and (c) shows defects with line patterns (ghost bands)

DETAILED DESCRIPTION OF EMBODIMENTS OF THE INVENTION

An embodiment of the present invention is described below. The present invention, however, is not limited to the following embodiment.

The present invention represents a steel sheet and a plated steel sheet, and a method for producing a hot-rolled steel sheet, a method for producing a cold-rolled full-hard steel sheet, a method for producing a steel sheet, and a method for producing a plated steel sheet. The following first describes how these are related to one another.

The steel sheet according to embodiments of the present invention is produced from a starting steel material such as a slab through a manufacturing process that produces a hot-rolled steel sheet, and a cold-rolled full-hard steel sheet in succession. The plated steel sheet of the present invention is produced by plating the steel sheet.

The method for producing a hot-rolled steel sheet of the present invention is a method that produces the hot-rolled steel sheet in the foregoing process.

The method for producing a cold-rolled full-hard steel sheet of the present invention is a method that produces a cold-rolled full-hard steel sheet from the hot-rolled steel sheet in the foregoing process.

The method for producing a steel sheet of the present invention is a method that produces a steel sheet from the cold-rolled full-hard steel sheet in the foregoing process.

The method for producing a plated steel sheet of the present invention is a method that produces a plated steel sheet from the steel sheet in the foregoing process.

Because of these relationships, the hot-rolled steel sheet, the cold-rolled full-hard steel sheet, the steel sheet, and the plated steel sheet share the same composition, and the steel sheet and the plated steel sheet share the same micro structure. The following describes these common characteristics first, and hot-rolled steel sheet, the steel sheet, the plated steel sheet, and the producing methods will be described later.

Composition of Steel Sheet and Plated Steel Sheet

The steel sheet and the plated steel sheet have a composition containing, in mass %, C: 0.0008 to 0.0024%, Si: less than 0.15%, Mn: more than 0.55% and less than 0.90%, P: more than 0.025% and less than 0.050%, S: 0.015% or less, sol. Al: 0.01% or more and 0.1% or less, N: 0.01% or less, B: more than 0.0003% and less than 0.0035%, Nb: more than 0.005% and less than 0.016%, Ti: 0.009% or less, and Sb: 0.002 to 0.030%, in which C and Nb satisfy the following formula (1)

$$-10 \leq ([\%\ C]-([\%\ Nb]/93)\times 12)\times 10{,}000 \leq 14,$$

and in which the balance is Fe and unavoidable impurities.

The composition may further contain, in mass %, at least one of V: 0.1% or less, W: 0.1% or less, Zr: 0.03% or less, Mo: 0.15% or less, and Cr: 0.15% or less.

The composition may further contain, in mass %, at least one of Sn: 0.1% or less, Cu: 0.2% or less, Ni: 0.2% or less, Ca: 0.01% or less, Ce: 0.01% or less, La: 0.01% or less, and Mg: 0.01% or less.

The components are described below. In the following, "%" representing the content of the component means percent by mass.

C: 0.0008 to 0.0024%

Carbon is an essential element for providing the BH characteristic. A carbon content of at least 0.0008% is needed to provide a bake hardenability (BH) of 20 MPa or more. A carbon content of 0.0008% is needed also from the viewpoint of producing fine ferrite grains, and providing a high U.El. The NbC precipitates in excess, and a high U.El cannot be provided when the carbon content is more than 0.0024%. With such a high carbon content, the BH increases above 60 MPa, and a sufficient aging resistance cannot be provided. For this reason, the C content is 0.0008 to 0.0024%.

Si: Less than 0.15%

Silicon can be used as a solid solution strengthening element. However, a Si content of 0.15% or more causes severe scale patterns and bare spots due to surface oxidation. For this reason, the Si content is less than 0.15%.

Mn: More than 0.55% and Less than 0.90%

Manganese is an important element in embodiments of the present invention. Manganese is contained as a solid solution strengthening element to reduce phosphorus, and to prevent surface defects (streak-pattern defects) due to phosphorus. Reducing phosphorus with manganese lowers the $\gamma \rightarrow \alpha$ transformation point, and enables lowering the finishing rolling temperature. This makes it possible to improve surface quality (eliminate scale-pattern defects), and to produce fine ferrite grains. From this standpoint, manganese needs to be contained in an amount of more than 0.55%. On the other hand, a Mn content of 0.90% or more causes severe scale patterns and bare spots due to surface oxidation. For this reason, the Mn content is less than 0.90%. From the viewpoint of producing a fine structure and improving surface quality, the lower limit of Mn content is preferably more than 0.65%, and the upper limit of Mn content is preferably 0.85% or less.

P: More than 0.025% and Less than 0.050%

Phosphorus can be used as a solid solution strengthening element. However, phosphorus causes surface defects (streak-pattern defects (black streak, white streak)) as a result of segregation at the time of casting, and deteriorates the powdering resistance. A P content of more than 0.025% is needed to provide a predetermined TS. The P content needs to be less than 0.050% to provide surface quality. The lower limit of P content is preferably more than 0.030%, more preferably 0.032% or more.

S: 0.015% or Less

Sulfur acts to improve descaleability during hot rolling, and the quality of external appearance. However, when retained in excess, sulfur causes surface defects (line-pattern defects) due to generation of coarse MnS. For this reason, the S content is 0.015% or less.

Sol. Al: 0.01% or More and 0.1% or Less

Aluminum is used as a deoxidizing element. When the B and Nb contents are small, aluminum acts to fix nitrogen in the form of AlN, and improve aging resistance at room temperature. From this standpoint, the sol. Al content is 0.01% or more. The effect becomes saturated, and the cost increases when sol. Al is contained in an amount of more than 0.1%. Such a high sol. Al content also leads to poor castability, and deteriorates the surface quality. For this reason, the sol. Al content is 0.1% or less.

N: 0.01% or Less

Nitrogen is an element that forms carbonitrides and nitrides such as Nb(C,N), BN, AlN, and TiN in the steel, and causes BH to fluctuate by generating Nb(C,N). A N content of more than 0.01% leads to poor aging resistance. For this reason, the N content is 0.01% or less.

B: More than 0.0003% and Less than 0.0035%

Boron fixes nitrogen by forming a stable compound BN, and reduces Nb(C,N). In this way, boron acts to improve aging resistance. From this standpoint, the B content is more than 0.0003%. The B content is less than 0.0035% because containing boron in an amount of 0.0035% or more has no material improving effect, but only increases the excess solid solution B, and deteriorates castability.

Nb: More than 0.005% and Less than 0.016%

Niobium has the effect to improve aging resistance by fixing carbon and nitrogen. Niobium also acts to improve U.El by making crystal grains finer. Niobium needs to be contained in an amount of more than 0.005% to obtain these effects. However, when the niobium content is 0.016% or more, U.El decreases, and surface defects (scale-pattern defects) occur as a result of generation of large amounts of precipitates. That is, it is important to control the Nb content in the less than 0.016% range to provide high U.El and excellent surface quality. For these reasons, the Nb content is more than 0.005% and less than 0.016%.

Ti: 0.009% or Less

Titanium has the effect to improve aging resistance by fixing nitrogen. However, increasing the Ti content causes ferrite grains to coarsen through formation of coarse TiN. A high Ti content also lowers BH through formation of TiC, and causes variation in BH. A high Ti content also accelerates nitridation in the steel sheet surface layer, and causes surface defects (line-pattern defects) by forming fine grains and unrecrystallized grains in the surface layer. For these reasons, the Ti content needs to be restricted to 0.009% or less.

Sb: 0.002 to 0.030%

Antimony has the effect to improve surface quality by reducing nitridation and oxidation of steel sheet surface. To describe more specifically, surface defects (scale-pattern defects) tend to occur in a Mn-rich steel. In a B-containing steel, a fine structure tends to occur in surface layer as a result of nitridation or oxidation of boron in the surface layer. This makes the ds/d ratio (described later) fall outside the range of embodiments of the present invention, and surface defects (line-pattern defects) become likely to occur. Antimony acts to reduce these defects. From this standpoint, antimony is contained in an amount of preferably 0.002% or more. When contained in an amount of more than 0.030%, antimony segregates at the grain boundaries, and causes deterioration of brittleness for secondary working. For these reasons, the Sb content is 0.002 to 0.030%. The lower limit of Sb content is preferably more than 0.002%, more preferably 0.005% or more. The upper limit of Sb content is preferably 0.020% or less, more preferably 0.015% or less.

([% C]−([% Nb]/93)×12)×10,000: −10 or More and 14 or Less

In order to provide excellent bake hardenability and aging resistance, it is required to at least control the Nb content according to the C content, and optimize the solid solution C content. From this standpoint, ([% C]−([% Nb]/93)×12)×10,000 needs to be −10 or more and 14 or less.

The basic configuration according to embodiments of the present invention is as above. The composition may further contain, in mass %, at least one of V: 0.1% or less, W: 0.1% or less, Zr: 0.03% or less, Mo: 0.15% or less, and Cr: 0.15% or less.

V: 0.1% or Less

Vanadium may be contained to increase strength. From the viewpoint of increasing strength, the V content is preferably 0.002% or more, more preferably 0.01% or more. However, the V content is desirably 0.1% or less because, when contained in an amount of more than 0.1%, vanadium lowers BH, and greatly increases cost.

W: 0.1% or Less

Tungsten can be used as a precipitation strengthening element. From the viewpoint of increasing strength, tungsten is contained in an amount of preferably 0.002% or more. However, the W content is desirably 0.1% or less because an excessively high W content lowers BH.

Zr: 0.03% or Less

Zirconium also can be used as a precipitation strengthening element, and may be contained to fix nitrogen. From the viewpoint of fixing nitrogen, zirconium is contained in an amount of preferably 0.002% or more, more preferably 0.005% or more. However, the Zr content is desirably 0.03% or less because an excessively high Zr content lowers BH.

Mo: 0.15% or Less

Molybdenum also can be used as a precipitation strengthening element. From the viewpoint of fixing carbon, molybdenum is contained in an amount of preferably 0.002% or more, more preferably 0.005% or more. However, the Mo content is desirably 0.15% or less because an excessively high Mo content lowers BH.

Cr: 0.15% or Less

Chromium can be used to reduce diffusion of carbon, and to improve aging resistance at room temperature. From this standpoint, chromium is contained in an amount of preferably 0.04% or more. However, the Cr content is desirably 0.15% or less because an excessively high Cr content leads to poor corrosion resistance.

The composition may further contain, in mass %, at least one of Sn: 0.1% or less, Cu: 0.2% or less, Ni: 0.2% or less, Ca: 0.01% or less, Ce: 0.01% or less, La: 0.01% or less, and Mg: 0.01% or less.

Sn: 0.1% or Less

Tin acts to reduce nitridation and oxidation of steel sheet surface, and improve surface quality. From this standpoint, tin is contained in an amount of preferably 0.002% or more, more preferably 0.005% or more. However, the Sn content is desirably 0.1% or less because a Sn content of more than 0.1% increases the yield ratio (YP), and causes deterioration of brittleness for secondary working.

Cu: 0.2% or Less

Copper improves aging resistance and chipping resistance. Copper is also an element that becomes incorporated when using a scrap as raw material, and, by allowing entry of copper, a recycled material can be used as a raw material, and the manufacturing cost can be reduced. From this standpoint, copper is contained in an amount of preferably 0.01% or more, more preferably 0.03% or more. However, the Cu content is desirably 0.2% or less because an excessively high Cu content causes surface defects.

Ni: 0.2% or Less

Nickel acts to reduce surface defects, which often occur when copper is added. From this standpoint, nickel is contained in an amount of preferably 0.01% or more, more preferably 0.02% or more. However, an excessively high Ni content causes uneven generation of scales in a heating furnace, which leads to surface defects, and very high cost. For this reason, the Ni content is 0.2% or less.

Ca: 0.01% or Less

Calcium acts to fix the sulfur in the steel in the form of CaS, and improve formability by reducing MnS generation. From this standpoint, calcium is contained in an amount of preferably 0.0005% or more. However, calcium tends to undergo floating separation in the form of an oxide in molten steel, and it is difficult to retain large amounts of calcium in the steel. For this reason, the Ca content is 0.01% or less.

Ce: 0.01% or Less

Cerium fixes the sulfur in the steel, and may be contained to improve formability. From this standpoint, cerium is contained in an amount of preferably 0.0005% or more. However, because cerium is an expensive element, adding large amounts of cerium increases cost. It is accordingly desirable to add cerium in an amount of 0.01% or less.

La: 0.01% or Less

Lanthanum fixes the sulfur in the steel, and may be contained to improve formability. From this standpoint, lanthanum is contained in an amount of 0.0005% or more. However, because lanthanum is an expensive element, adding large amounts of lanthanum increases cost. It is accordingly desirable to add lanthanum in an amount of 0.01% or less.

Mg: 0.01% or Less

Magnesium may be contained to finely disperse oxides, and produce a fine structure. From this standpoint, magnesium is contained in an amount of 0.0005% or more.

However, the Mg content is desirably 0.01% or less because a high Mg content causes deterioration of surface quality.

The balance is Fe and unavoidable impurities.

Structure of Steel Sheet and Plated Steel Sheet

The steel sheet and the plated steel sheet have a micro structure in which ferrite has an average crystal grain diameter d of 8 to 18 μm at a ¼ thickness position of the sheet, and a ds/d ratio of 0.40 to 1.20, where ds is the average crystal grain diameter of ferrite in a steel sheet surface layer. The micro structure according to embodiments of the present invention is a ferrite single-phase structure, and includes ferrite, a trace amount of precipitate, and inclusions. Accordingly, the structure excludes a secondary-phase structure such as perlite, martensite, bainite, and retained γ.

Ferrite has Average Crystal Grain Diameter d of 8 to 18 μm at ¼ Thickness Position of Sheet In order to obtain a high U.El, the steel sheet needs to have fine crystal grains. However, overly fine crystal grains increase YP, and deteriorate formability. For this reason, ferrite has an average crystal grain diameter d of 8 to 18 μm at a ¼ thickness position of the sheet.

MicroStructure Has a ds/d Ratio of 0.40 to 1.20 (ds is the average crystal grain diameter of ferrite in a steel sheet surface layer, and d is the average crystal grain diameter of ferrite at a ¼ thickness position of the sheet)

Fine grains occur in the steel sheet surface layer when nitridation occurs in the steel sheet surface layer. The presence of a fine structure and unrecrystallized grains causes line-pattern defects (ghost bands). Coarse grains may occur in the surface layer when the coiling temperature exceeds 680° C. Coarse grains cause a rough surface after pressing. The ds/d ratio is 0.40 to 1.20 to reduce these defects. The ds/d ratio may be controlled within the range of 0.40 or more by controlling the Sb content, the dew point, the P content, and the Ti content within the predetermined ranges.

The average crystal grain diameter of ferrite is measured in a cross section parallel to the steel sheet rolling direction (a cross section through the sheet thickness). The surface is etched with nital to such an extent that most grain boundaries are clearly observable, and the surface is observed with a light microscope at 100 to 400 times magnification. The average crystal grain diameter ds of ferrite in the steel sheet surface layer is the average of crystal grain diameters measured in a region over a distance of 50 μm into the steel sheet from the outermost surface. The average crystal grain diameter d of ferrite at a ¼ thickness position of the sheet is the average crystal grain diameter measured in a region around a ¼ thickness position of the sheet, which is an important region for evaluation of formability. Here, the measured area needs to large enough to sufficiently reduce the measurement variation of crystal grain diameter, and is, for example, about 50,000 $\mu m^2$. The crystal grain diameter is measured according to JIS G 0551. Measurement may be made using the counting method, in which the crystal grain diameter is calculated from the number of crystal grains present in a predetermined region, or the intercept method, in which the crystal grain diameter is calculated from the number of grain boundaries crossing line segments. In the present invention, the crystal grain diameter was measured by using the counting method. When using the intercept method, it is important to draw measurement lines at sufficiently small intervals in rolling direction and sheet thickness direction so that flat crystal grains, and crystal granularity changes occurring in a direction from the surface layer into the steel sheet do not appear as large measurement errors.

Steel Sheet

The steel sheet has the composition and the micro structure described above. The steel sheet has a thickness of typically 0.50 to 0.85 mm, though it is not particularly limited.

Plated Steel Sheet

The plated steel sheet according to embodiments of the present invention is a plated steel sheet having a plating layer on the steel sheet of the present invention. The plating layer is not particularly limited, and may be, for example, a hot-dip plating layer, or an electroplating layer. The plating layer may be an alloyed plating layer. The plating layer is preferably a galvanized layer. The galvanized layer may contain aluminum or magnesium. A hot-dip zinc-aluminum-magnesium alloyed plating (a Zn—Al—Mg plating layer) is also preferred. In this case, it is preferable that the Al content be 1 mass % to 22 mass %, and the Mg content be 0.1 mass % to 10 mass %. It is also possible to incorporate one or more selected from Si, Ni, Ce, and La in a total amount of 1% or less. The plated metal is not particularly limited, and other metals, for example, aluminum may be used for plating, other than zinc.

The composition of the plating layer is not particularly limited either, and the plating layer may have a common composition. For example, it is preferable to provide a hot-dip galvanized layer deposited with 20 to 80 $g/m^2$ of plating each side, and an alloyed hot-dip galvanized layer formed by alloying such a hot-dip galvanized layer. The Fe content in the plating layer is less than 7 mass % when the plating layer is a hot-dip galvanized layer, and 7 to 15 mass % when the plating layer is an alloyed hot-dip galvanized layer.

Hot-Rolled Steel Sheet Producing Method

The method for producing a hot-rolled steel sheet according to embodiments of the present invention is a method that includes:

heating a steel slab of the composition described in the foregoing section "Composition of Steel Sheet and Plated Steel Sheet;

hot rolling the steel slab with a cumulative rolling reduction ratio of 50% or more in a temperature region of 1,000° C. or less, a finish rolling entry-side temperature of 1,080° C. or less, and a finish rolling exit-side temperature of more than 850° C. and less than 910° C.;

cooling to 720 to 800° C. at an average cooling rate of 20° C./sec or more;

retaining for 5 seconds or more in the temperature region of 720 to 800° C.; and coiling at a coiling temperature of 580 to 680° C.

The following describes these conditions. In the following descriptions, "temperature" means steel sheet surface temperature, unless otherwise specifically stated. Steel sheet surface temperature can be measured with a radiation thermometer or the like. The average cooling rate is (surface temperature before cooling−surface temperature after cooling)/cooling time.

Production of Steel Slab

The method used to make steel for the production of the steel slab is not particularly limited, and the steel may be produced using a known steel producing method such as a method using a converter, and a method using an electric furnace. Preferably, secondary refining is performed using a vacuum degassing furnace. For productivity and quality, the refined steel is preferably formed into a slab (steel material) by continuous casting. It is also possible to form a slab using a known casting method such as ingot casting-break down rolling, and thin slab continuous casting.

Heating of Steel Slab

The steel slab may be hot rolled by, for example, a method that rolls the heated slab, a method that directly rolls the slab after continuous casting without heating, or a method that rolls the continuously cast slab after a brief heat treatment. The slab may be heated at a temperature of 1,100 to 1,300° C.

Cumulative Rolling Reduction Ratio in Temperature Region of 1,000° C. or Less is 50% or More The diameter d can be confined in the range of embodiments of the present invention when the cumulative rolling reduction ratio in a temperature region of 1,000° C. or less is 50% or more.

Finish Rolling Entry-Side Temperature is 1,080° C. or Less, and Finish Rolling Exit-Side Temperature is More than 850 and Less Than 910° C.

Scale-pattern defects can be reduced when the finish rolling entry-side temperature is 1,080° C. or less. With a finish rolling exit-side temperature of more than 850° C. and less than 910° C., a fine structure occurs, and the diameter d can be confined within the range of embodiments of the present invention, in addition to providing excellent aging resistance. It is also possible to reduce scale-pattern defects.

Cooling to 720 to 800° C. at Average Cooling Rate of 20° C./Sec or More, and Retaining for 5 Seconds or More in Temperature Region of 720 to 800° C.

After the finish rolling, the steel is quenched to 720 to 800° C. at an average cooling rate of 20° C./second or more, and retained for 5 seconds or more in this temperature region. In this way, fine ferrite can occur in the hot-rolled sheet, and the steel sheet can have a fine structure after annealing. This makes the diameter d fall within the range of embodiments of the present invention. A fine structure cannot be obtained when the cooling rate is less than 20° C./sec, and the cooling stop temperature is more than 800° C. When the cooling stop temperature is less than 720° C., and the retention time is less than 5 seconds, the r value greatly decreases, and an r value of 1.4 or more cannot be provided.

Coiling at Coiling Temperature of 580 to 680° C.

By coiling the steel at a coiling temperature of 580 to 680° C., a structure with the desired grain diameter can be obtained without creating an overly fine structure. It is also possible to obtain a high r value of 1.4 or more.

In order to produce a plated surface of cosmetic quality that is particularly appealing, it is desirable to descale the steel sheet surface under a water pressure of 300 MPa or more before finish rolling so as to remove the primary and secondary scales generated on the steel sheet surface.

Once coiled, the steel sheet is cooled by air or by some other means, and is used to produce a cold-rolled full hard steel sheet, as described below.

Cold-Rolled Full-Hard Steel Sheet Producing Method

The method for producing a cold-rolled full-hard steel sheet of the present invention is a method that produces a cold-rolled full-hard steel sheet by cold rolling the hot-rolled steel sheet produced by using the method described above.

In view of increasing the r value and improving formability, the steel sheet is cold rolled at a rolling ratio of preferably 60 to 95%. In view of producing fine grains, the lower limit of cold rolling ratio is particularly preferably 75% or more, and the upper limit of cold rolling ratio is particularly preferably 85% or less.

The steel sheet may be pickled before cold rolling. The pickling conditions may be appropriately set.

Steel Sheet Producing Method

The method for producing a steel sheet according to embodiments of the present invention is a method that includes:

annealing in which the cold-rolled full-hard steel sheet obtained by the foregoing method is heated at an average heating rate of 1 to 8° C./sec in a temperature region of 660 to 760° C., and soaked at an annealing temperature of 760° C. to 830° C. for 30 to 240 seconds with a dew point in a temperature region of 760° C. or more set to −30° C. or less.

Heating at Average Heating Rate of 1 to 8° C./Sec in Temperature Region of 660 to 760° C.

The average heating rate of annealing is 1 to 8° C./sec in a temperature region of 660 to 760° C. With an average heating rate of 1° C./second or more, excess coarsening of ferrite grains can be reduced. With an average heating rate of 8° C./sec or less, retention of recovered grains can be reduced. This makes it possible to obtain a fine ferrite grain structure of primarily recrystallized grains, which contributes to improving U.El.

Dew Point in Temperature Region of 760° C. or More is −30° C. or Less

A desirable surface quality can be provided when the dew point in a temperature region of 760° C. or more is −30° C. or less. A BH of 20 MPa or more also can be achieved with such a dew point. When the dew point has a higher value above−30° C., oxidation of manganese and boron become prominent, and scale-pattern defects occur. With such a high dew point, boron is consumed in the form of an oxide, and the BH may fall below 20 MPa, and the aging resistance deteriorates. For this reason, a dew point of −30° C. or less is set for a temperature region of 760° C. or more. The lower limit of the atmospheric dew point is not particularly limited, and is preferably −80° C. or more because the effect becomes saturated, and poses a cost disadvantage when the dew point is less than −80° C. It is to be noted here that the temperature in the foregoing temperature region is based on the surface temperature of the steel sheet. That is, the dew point is adjusted in the foregoing range when the steel sheet surface temperature is in the foregoing temperature region.

Soaking for 30 to 240 Seconds at Annealing Temperature of 760° C. or More and 830° C. or Less The annealing temperature is 760° C. or more and 830° C. or less. A fine grain structure can be obtained by annealing at 830° C. or less. With such an annealing temperature, it is also possible to obtain excellent aging resistance, and to reduce scale-pattern defects, and provide a desirable surface quality. However, the annealing temperature is 760° C. or more because, when it is too low, a distribution of unrecrystallized grains occurs in the surface layer. The soaking time needs to be 30 to 240 seconds, in order to reduce the fine structure in a ¼ thickness position of the sheet, and the occurrence of scale-pattern defects, and to reduce the unrecrystallized structure in the surface layer (including a recovered structure, and an overly fine grain structure) and therefore generation of line-pattern defects (ghost bands). Specifically, the soaking time is preferably 70 to 240 seconds for annealing at 760° C. to 780° C., 50 to 200 seconds for annealing at more than 780° C. and 815° C. or less, and 30 to 150 seconds for annealing at more than 815° C. and 830° C. or less. Here, the soaking time is the retention time in a temperature range between annealing temperature (maximum achieving temperature) and annealing temperature minus 30° C.

The conditions after the annealing are not particularly limited. It is, however, preferable to cool the steel sheet from the annealing temperature to 100° C. or less at a rate of 5 to 50° C./sec. When the temperature passes the overaging zone of 250 to 500° C. after the annealing, the steel sheet is preferably cooled to a temperature of 250 to 500° C. at a rate of 5 to 50° C./sec, and to 100° C. or less at 5 to 1,000° C./sec after being retained for 50 to 400 seconds at 250 to 500° C.

Plated Steel Sheet Producing Method

The method for producing a plated steel sheet according to embodiments of the present invention is a method that produces a plated steel sheet by plating the steel sheet. For example, the plating process may be hot-dip galvanization, or a process that involves alloying after hot-dip galvanization. Annealing and galvanization may be continuously performed in a single line. As another example, a plating layer may be formed by electroplating such as Zn—Ni alloy electroplating, or by hot-dip zinc-aluminum-magnesium alloy plating. As described above in conjunction with the plating layer, the plating is preferably Zn plating. It is possible, however, to use other metals, such as in Al plating.

For example, in the case of galvanization, it is preferable to cool the steel sheet from the annealing temperature at an average cooling rate of 3 to 20° C./sec before dipping the steel sheet in a galvanization bath of about 460° C. The steel sheet is then dipped and galvanized in a galvanization bath, and, as required, may be subjected to an alloying treatment, in which the steel sheet is retained for at most 40 seconds in a temperature region of 500 to 600° C. Preferably, the steel sheet is cooled to 200° C. or less at an average cooling rate of 5 to 100° C./sec after galvanization, or after the alloying treatment when it is performed.

The steel sheet or the plated steel sheet so obtained may be subjected to skin-pass rolling, in order to adjust surface roughness, or stabilize press formability such as in flattening the sheet. In this case, the skin-pass stretch rate is preferably 0.8 to 1.6% in view of decreasing YP and increasing U.El.

Example 1

After producing the steels shown in Table 1, the steels were each continuously cast into a slab of 220 to 260 mm thickness.

TABLE 1

(mass %)

| Steel No. | C | Si | Mn | P | S | sol. Al | N | Nb | Ti | B | Sb | Formula (1) | others | Remarks |
|---|---|---|---|---|---|---|---|---|---|---|---|---|---|---|
| A | 0.0012 | 0.01 | 0.70 | 0.035 | 0.007 | 0.050 | 0.0018 | 0.007 | tr. | 0.0012 | 0.007 | 3.0 | | Present steel |
| B | 0.0020 | 0.04 | 0.64 | 0.036 | 0.006 | 0.040 | 0.0022 | 0.009 | 0.003 | 0.0015 | 0.008 | 8.4 | | Present steel |
| C | 0.0012 | 0.03 | 0.57 | 0.041 | 0.009 | 0.058 | 0.0018 | 0.008 | tr. | 0.0013 | 0.010 | 1.7 | | Present steel |
| D | 0.0015 | 0.01 | 0.85 | 0.026 | 0.007 | 0.035 | 0.0018 | 0.007 | 0.004 | 0.0012 | 0.007 | 6.0 | | Present steel |
| E | 0.0013 | 0.01 | 0.72 | 0.036 | 0.007 | 0.015 | 0.0016 | 0.014 | tr. | 0.0015 | 0.007 | −5.1 | | Present steel |
| F | 0.0013 | 0.08 | 0.75 | 0.028 | 0.010 | 0.012 | 0.0030 | 0.009 | tr. | 0.0009 | 0.015 | 1.4 | Zr: 0.007, Cr: 0.06, Cu: 0.05, Ni: 0.04 | Present steel |
| G | 0.0014 | 0.02 | 0.70 | 0.027 | 0.008 | 0.070 | 0.0048 | 0.007 | 0.005 | 0.0030 | 0.010 | 5.0 | W: 0.008, V: 0.02, Ca: 0.0015 | Present steel |
| H | 0.0010 | 0.01 | 0.82 | 0.031 | 0.005 | 0.030 | 0.0035 | 0.006 | 0.003 | 0.0022 | 0.012 | 2.3 | Mo: 0.04, Ce: 0.0015 | Present steel |
| I | 0.0018 | 0.01 | 0.80 | 0.026 | 0.003 | 0.025 | 0.0025 | 0.009 | 0.002 | 0.0015 | 0.015 | 6.4 | Sn: 0.015, La: 0.0015, Mg: 0.0015 | Present steel |
| J | 0.0036 | 0.01 | 0.56 | 0.026 | 0.009 | 0.050 | 0.0025 | 0.016 | 0.004 | 0.0010 | 0.008 | 15.4 | | Comparative steel |
| K | 0.0015 | 0.02 | 0.40 | 0.052 | 0.010 | 0.042 | 0.0019 | 0.013 | tr. | 0.0011 | 0.010 | −1.8 | | Comparative steel |
| L | 0.0018 | 0.02 | 0.67 | 0.040 | 0.005 | 0.030 | 0.0026 | 0.010 | tr. | 0.0014 | tr. | 5.1 | | Comparative steel |
| M | 0.0019 | 0.01 | 0.59 | 0.040 | 0.005 | 0.060 | 0.0026 | 0.010 | tr. | tr. | tr. | 6.1 | | Comparative steel |
| N | 0.0017 | 0.01 | 0.64 | 0.040 | 0.005 | 0.045 | 0.0020 | 0.011 | tr. | tr. | 0.010 | 2.8 | | Comparative steel |

Formula (1): ([% C] − ([% Nb]/93) × 12) × 10,000

The slab was heated to 1,180 to 1,250° C., and hot rolled under the hot rolling conditions shown in Table 2 to produce a hot-rolled sheet. The hot-rolled sheet was cold rolled at the rolling ratio shown in Table 2 to produce a cold-rolled sheet having a sheet thickness of 0.6 to 0.8 mm.

The cold-rolled sheet was annealed under the conditions shown in Table 2, using a continuous hot-dip galvanization line (CGL) or a continuous annealing line (CAL). The atmospheric gas in the furnace was $H_2$: 8%, and $N_2$: 92%. The hot-dip galvanized steel sheet was dipped and galvanized in a plating bath. Some of the samples were cooled to room temperature after an alloying treatment. The galvanization was performed at a bath temperature of 460° C. in the presence of 0.13% Al in the bath. In the alloying treatment, the steel sheet dipped in a plating bath was heated to 480 to 540° C. at an average heating rate of 15° C./sec, and retained for 10 to 25 seconds to make the Fe content of the plating 9 to 12%. The plating was deposited on both sides, 47 g/m$^2$ each. The hot-dip galvanized steel sheet (GI), the alloyed hot-dip galvanized steel sheet (GA), or the steel sheet (CR) was subjected to temper rolling at a stretch rate of 1.2% to obtain a steel sheet.

TABLE 2

| | | Hot rolling conditions | | | | | | | | Annealing conditions | | | | | |
|---|---|---|---|---|---|---|---|---|---|---|---|---|---|---|---|
| Steel sheet No. | Steel No. | Cumulative rolling reduction ratio at 1,000° C. or less (%) | Finish rolling exit-side temperature (° C.) | Finish rolling entry-side temperature (° C.) | Average cooling rate (° C./sec) | Retention temp. (° C.) | Retention time (sec) | Coiling temp. (° C.) | Cold rolling Rolling reduction ratio (%) | Average heating rate in 660 to 760° C. temperature region (° C./sec) | Annealing temp. (° C.) | Retention time (sec) | Dew point at 760° C. or more (° C.) | Presence or absence of plating/alloying | Remarks |
| 1 | A | 65 | 880 | 1040 | 35 | 750 | 7 | 650 | 78 | 1 | 760 | 120 | −50 | GA | Present example |
| 2 | | 65 | 880 | 1030 | 35 | 750 | 7 | 650 | 80 | 2 | 780 | 120 | −48 | GI | Present example |
| 3 | | 65 | 880 | 1045 | 35 | 750 | 6 | 650 | 82 | 1 | 780 | 120 | −52 | CR | Present example |
| 4 | | 70 | 880 | 1040 | 45 | 740 | 7 | 640 | 79 | 7 | 800 | 100 | −53 | GA | Present example |
| 5 | | 73 | 880 | 1070 | 100 | 720 | 5 | 620 | 79 | 3 | 820 | 40 | −50 | GA | Present example |
| 6 | | 60 | 895 | 1050 | 35 | 795 | 8 | 680 | 79 | 2 | 830 | 250 | −45 | GA | Comparative example |
| 7 | | 70 | 880 | 1090 | 35 | 750 | 7 | 620 | 82 | 3 | 820 | 120 | −42 | GA | Comparative example |
| 8 | | 70 | 880 | 1050 | 35 | 770 | 7 | 680 | 80 | 2 | 850 | 100 | −28 | GA | Comparative example |
| 9 | B | 73 | 890 | 1030 | 35 | 750 | 8 | 670 | 78 | 5 | 770 | 70 | −42 | GA | Present example |
| 10 | C | 70 | 905 | 1025 | 30 | 750 | 9 | 650 | 80 | 4 | 810 | 180 | −48 | GA | Present example |
| 11 | | 70 | 905 | 1030 | 35 | 830 | 7 | 680 | 75 | 2 | 815 | 200 | −48 | GA | Comparative example |
| 12 | | 70 | 905 | 1050 | 10 | 795 | 6 | 680 | 75 | 2 | 815 | 180 | −48 | GA | Comparative example |
| 13 | | 55 | 930 | 1030 | 35 | 830 | 5 | 680 | 75 | 2 | 815 | 200 | −48 | GA | Comparative example |
| 14 | | 29 | 930 | 1040 | 35 | 830 | 5 | 680 | 75 | 2 | 815 | 180 | −45 | GA | Comparative example |
| 15 | | 73 | 905 | 1050 | 35 | 790 | 5 | 740 | 75 | 2 | 815 | 180 | −45 | GA | Comparative example |
| 16 | | 73 | 905 | 1040 | 50 | 790 | 2 | 620 | 75 | 2 | 815 | 180 | −45 | GA | Comparative example |
| 17 | | 73 | 905 | 1040 | 35 | 790 | 5 | 680 | 75 | 0.4 | 815 | 180 | −48 | GA | Comparative example |
| 18 | D | 73 | 890 | 1020 | 35 | 740 | 6 | 660 | 80 | 4 | 790 | 100 | −45 | GA | Present example |
| 19 | | 73 | 890 | 1010 | 80 | 740 | 6 | 640 | 80 | 4 | 805 | 100 | −45 | GA | Present example |
| 20 | | 73 | 890 | 1090 | 15 | 830 | 6 | 650 | 80 | 4 | 835 | 100 | −45 | GA | Comparative example |

TABLE 2-continued

| | | Hot rolling conditions | | | | | | | | Annealing conditions | | | | | |
|---|---|---|---|---|---|---|---|---|---|---|---|---|---|---|---|
| Steel sheet No. | Steel No. | Cumulative rolling reduction ratio at 1,000° C. or less (%) | Finish rolling exit-side temperature (° C.) | Finish rolling entry-side temperature (° C.) | Average cooling rate (° C./sec) | Retention temp. (° C.) | Retention time (sec) | Coiling temp. (° C.) | Cold rolling Rolling reduction ratio (%) | Average heating rate in 660 to 760° C. temperature region (° C./sec) | Annealing temp. (° C.) | Retention time (sec) | Dew point at 760° C. or more (° C.) | Presence or absence of plating/alloying | Remarks |
| 21 | E | 80 | 875 | 1020 | 35 | 780 | 5 | 680 | 78 | 5 | 815 | 90 | −47 | GA | Present example |
| 22 | F | 75 | 890 | 1040 | 40 | 750 | 5 | 660 | 78 | 5 | 780 | 90 | −47 | GA | Present example |
| 23 | G | 75 | 890 | 1070 | 90 | 740 | 5 | 670 | 78 | 5 | 780 | 120 | 47 | GA | Present example |
| 24 | H | 75 | 890 | 1070 | 40 | 730 | 5 | 670 | 78 | 5 | 780 | 120 | −47 | GA | Present example |
| 25 | I | 75 | 890 | 1060 | 35 | 720 | 5 | 630 | 78 | 5 | 795 | 80 | −47 | GA | Present example |
| 26 | J | 75 | 900 | 1060 | 35 | 790 | 6 | 660 | 78 | 2 | 830 | 80 | −47 | GA | Comparative example |
| 27 | K | 75 | 920 | 1050 | 40 | 790 | 6 | 650 | 78 | 2 | 830 | 80 | −37 | GA | Comparative example |
| 28 | L | 75 | 915 | 1050 | 35 | 790 | 6 | 660 | 78 | 2 | 820 | 100 | −47 | GA | Comparative example |
| 29 | M | 75 | 905 | 1040 | 35 | 790 | 6 | 640 | 78 | 2 | 805 | 100 | −47 | GA | Comparative example |
| 30 | N | 75 | 905 | 1050 | 35 | 790 | 6 | 650 | 78 | 2 | 805 | 100 | −47 | GA | Comparative example |

GA: Alloyed hot-dip galvanized steel sheet
GI: Hot-dip galvanized steel sheet (no alloying)
CR: Cold-rolled steel sheet The steel sheets were each measured for average crystal grain diameter ds in the steel sheet surface layer, and for average crystal grain diameter d in a ¼ thickness position of the sheet, using the methods described above. A JIS 5 test piece was collected in a direction orthogonal to rolling direction, and evaluated for yield ratio (YP), tensile strength (TS), uniform elongation (U.El), and total elongation (El) in a tensile test (conducted according to JIS Z2241). The test piece was determined as being acceptable when it had a TS of 340 MPa or more, and a TS×U.El (an index of a steel sheet having high strength and excellent formability) of 7,100 (MPa·%) or more.

The test piece was also determined for bake hardenability (BH), which is an increase of YP after a 170° C., 20-min heat treatment, as measured against the stress experienced by the same test piece under 2% prestrain. For the evaluation of aging resistance at room temperature, the same test piece was subjected to a heat treatment at 100° C. for 6 hours, and at 70° C. for 30 days, and the elongation at yield (YPEl) was measured after the heat treatment. The aging condition at 100° C. for 6 hours is equivalent to the aging condition at 25° C. for 6 months, and at 50° C. for 0.5 months, and represents a condition that needs to be taken into account when the steel sheet is to be used in Japan. The aging condition at 70° C. for 30 days is equivalent to the condition at 25° C. for 75 months, and at 50° C. for 6 months, and represents a condition that needs to be taken into account when the steel sheet is to be used in tropical areas such as Southeast Asia. In this Example, the steel sheet was determined as being acceptable when it had a BH of 20 MPa or more, and an YPEl of 0.5% or less after aging at 100° C. and at 70° C., in order to suitably meet the required conditions for use in tropical areas. The tensile test piece was collected in rolling direction, in a direction orthogonal to rolling direction, and in 45 degree-angle direction with respect to rolling direction, and an r value was measured under 12% tensile strain. The r value was determined from the measured r values in rolling direction L, a direction C orthogonal to rolling direction, and 45-degree angle direction D with respect to rolling direction, using the following formula.

$$\text{Average } r \text{ value} = (r_L + r_C + 2r_D)/4,$$

where $r_L$, $r_C$, and $r_D$ are the r values in directions L, C, and D, respectively. The test piece was determined as being acceptable when the average r value≥1.4. For cost considerations in manufacture, the upper limit of r value is essentially 2.2 or less.

The samples were also evaluated for surface quality over the entire length of a coil. The samples were examined for the presence or absence of white and black streak patterns (defect A) of about 1-mm width and about 100-mm length, and scale patterns (defect B), and were determined as being unacceptable when the coil had these defects. Separately, a strip test piece having a width equal to the entire coil width and a length L of 100 mm was collected from the both ends of a coil. After imparting 4% tensile strain in coil width direction, the test piece was ground with a grinding stone, and examined for the presence or absence of line patterns (defect C). Evaluation was made by visual inspection using the following criteria.

Excellent: No defect
Good: Minor defects
Poor: Defects are present, unacceptable FIG. 1 shows schematic views of typical forms of defects. The steel sheet (CR) does not involve defects A and B because these defects occur after galvanization.

The results are presented in Table 3.

TABLE 3

| Steel | | Structure | | | Mechanical properties | | | | | | | | | Presence or absence of | Presence or absence of | Presence or absence of | |
|---|---|---|---|---|---|---|---|---|---|---|---|---|---|---|---|---|---|
| sheet No. | Steel N. | ds (μm) | d (μm) | ds/d | YP (MPa) | TS (MPa) | BH (MPa) | U.EI (%) | EI (%) | TS × U.EI (MPa × %) | Average r value | YPEI after 100° C. aging (%) | YPEI after 70° C. aging (%) | defect A | defect B | defect C | Remarks |
| 1 | A | 6.8 | 10.5 | 0.65 | 238 | 355 | 28 | 23.6 | 42.3 | 8371 | 1.6 | 0 | 0 | Excellent | Excellent | Excellent | Present example |
| 2 | | 8.1 | 12.5 | 0.65 | 231 | 348 | 37 | 23.5 | 42.8 | 8171 | 1.8 | 0 | 0 | Excellent | Excellent | Excellent | Present example |
| 3 | | 8.4 | 12.5 | 0.67 | 231 | 348 | 37 | 23.2 | 42.6 | 8067 | 1.8 | 0 | 0 | — | — | Excellent | Present example |
| 4 | | 8.7 | 13.0 | 0.67 | 224 | 341 | 40 | 23.2 | 43.0 | 7904 | 1.7 | 0 | 0 | Excellent | Excellent | Excellent | Present example |
| 5 | | 10.0 | 14.5 | 0.69 | 217 | 340 | 42 | 22.9 | 42.8 | 7786 | 1.7 | 0 | 0 | Excellent | Excellent | Excellent | Present example |
| 6 | | 13.5 | 18.5 | 0.73 | 213 | 322 | 44 | 22.0 | 44.0 | 7084 | 1.7 | 0 | 0 | Excellent | Excellent | Excellent | Comparative example |
| 7 | | 11.6 | 16.5 | 0.70 | 217 | 340 | 42 | 22.7 | 42.4 | 7718 | 1.7 | 0 | 0.3 | Excellent | Poor | Excellent | Comparative example |
| 8 | | 7.4 | 19.5 | 0.38 | 206 | 320 | 16 | 22.0 | 45.0 | 7040 | 1.7 | 0 | 0.3 | Excellent | Poor | Excellent | Comparative example |
| 9 | B | 5.1 | 8.7 | 0.59 | 249 | 366 | 49 | 22.5 | 38.2 | 8244 | 1.6 | 0 | 0 | Excellent | Excellent | Excellent | Present example |
| 10 | C | 9.4 | 14.5 | 0.65 | 229 | 355 | 38 | 20.0 | 39.2 | 7100 | 1.5 | 0 | 0 | Excellent | Excellent | Excellent | Present example |
| 11 | | 13.0 | 18.5 | 0.7 | 225 | 342 | 38 | 19.8 | 40.8 | 6773 | 1.6 | 0 | 0 | Excellent | Excellent | Excellent | Comparative example |
| 12 | | 13.2 | 18.6 | 0.71 | 225 | 340 | 38 | 19.6 | 41.0 | 6664 | 1.6 | 0 | 0 | Excellent | Excellent | Excellent | Comparative example |
| 13 | | 12.6 | 18.5 | 0.68 | 220 | 340 | 38 | 19.8 | 41.2 | 6732 | 1.6 | 0 | 0 | Excellent | Poor | Excellent | Comparative example |
| 14 | | 13.5 | 18.5 | 0.73 | 225 | 340 | 38 | 19.7 | 41.0 | 6698 | 1.6 | 0 | 0 | Excellent | Poor | Excellent | Comparative example |
| 15 | | 24.7 | 19.0 | 1.3 | 210 | 338 | 38 | 19.6 | 41.4 | 6625 | 1.3 | 0 | 0 | Excellent | Good | Poor | Comparative example |
| 16 | | 10.5 | 14.0 | 0.75 | 250 | 355 | 38 | 21.3 | 40.0 | 7562 | 1.3 | 0 | 0 | Excellent | Good | Excellent | Comparative example |
| 17 | | 15.6 | 19.5 | 0.8 | 225 | 338 | 38 | 19.9 | 42.5 | 6726 | 1.7 | 0 | 0 | Excellent | Good | Excellent | Comparative example |
| 18 | D | 8.6 | 13.2 | 0.65 | 229 | 350 | 46 | 22.0 | 41.4 | 7700 | 1.7 | 0 | 0.3 | Excellent | Good | Excellent | Present example |
| 19 | | 9.6 | 14.7 | 0.65 | 224 | 345 | 48 | 21.5 | 41.2 | 7418 | 1.7 | 0 | 0.4 | Excellent | Good | Excellent | Present example |
| 20 | | 12.1 | 18.6 | 0.65 | 214 | 340 | 52 | 19.8 | 43.0 | 6732 | 1.7 | 0 | 0.6 | Excellent | Poor | Excellent | Comparative example |
| 21 | E | 5.8 | 8.9 | 0.65 | 220 | 340 | 28 | 24.6 | 42.0 | 8364 | 1.6 | 0 | 0 | Excellent | Excellent | Excellent | Present example |
| 22 | F | 5.1 | 10.4 | 0.49 | 236 | 353 | 33 | 23.5 | 41.8 | 8301 | 1.6 | 0 | 0 | Excellent | Excellent | Excellent | Present example |
| 23 | G | 6.8 | 12.3 | 0.55 | 248 | 365 | 42 | 22.3 | 40.7 | 8137 | 1.6 | 0 | 0 | Excellent | Excellent | Excellent | Present example |
| 24 | H | 7.9 | 13.7 | 0.58 | 240 | 357 | 35 | 21.7 | 40.1 | 7743 | 1.6 | 0 | 0 | Excellent | Excellent | Excellent | Present example |

TABLE 3-continued

| Steel sheet No. | Steel N. | Structure ds (μm) | d (μm) | ds/d | Mechanical properties YP (MPa) | TS (MPa) | BH (MPa) | U.EI (%) | EI (%) | TS × U.EI (MPa × %) | Average r value | YPEI after 100° C. aging (%) | YPEI after 70° C. aging (%) | Presence or absence of defect A | Presence or absence of defect B | Presence or absence of defect C | Remarks |
|---|---|---|---|---|---|---|---|---|---|---|---|---|---|---|---|---|---|
| 25 | I | 7.4 | 11.4 | 0.65 | 236 | 353 | 48 | 22.3 | 40.0 | 7871 | 1.6 | 0 | 0.3 | Excellent | Excellent | Excellent | Present example |
| 26 | J | 5.7 | 8.8 | 0.65 | 246 | 363 | 68 | 19.5 | 38.6 | 7077 | 1.3 | 0.6 | 1.8 | Excellent | Poor | Excellent | Comparative example |
| 27 | K | 7.1 | 18.2 | 0.39 | 224 | 341 | 32 | 19.8 | 42.0 | 6748 | 1.7 | 0 | 0 | Poor | Poor | Poor | Comparative example |
| 28 | L | 3.2 | 12.9 | 0.25 | 236 | 353 | 48 | 21.0 | 40.2 | 7412 | 1.6 | 0 | 0.6 | Good | Poor | Poor | Comparative example |
| 29 | M | 3.5 | 11.3 | 0.31 | 240 | 357 | 48 | 21.0 | 39.0 | 7499 | 1.6 | 0.3 | 1.5 | Good | Poor | Poor | Comparative example |
| 30 | N | 5.8 | 10.5 | 0.55 | 234 | 351 | 40 | 21.0 | 40.0 | 7376 | 1.6 | 0.2 | 1.3 | Good | Poor | Good | Comparative example |

A: Streak-pattern defect (black streak, white streak)
B: Scale-pattern defect
C: Line-pattern defect (ghost bands)
Excellent: No defect
Good: Minor defect (acceptable)
Poor: Defects are present (unacceptable)

The examples of the present invention (present examples) had high TS×U.El values, and excellent formability. The defects were reduced in all of the present examples, and the surface quality was desirable.

The invention claimed is:

1. A steel sheet of a composition comprising, in mass %, C: 0.0008 to 0.0024%, Si: less than 0.15%, Mn: more than 0.55% and less than 0.90%, P: more than 0.025% and less than 0.050%, S: 0.015% or less, sol. Al: 0.01% or more and 0.1% or less, N: 0.01% or less, B: more than 0.0003% and less than 0.0035%, Nb: more than 0.005% and less than 0.016%, Ti: 0.009% or less, and Sb: 0.002 to 0.030%, in which C and Nb satisfy the following formula (1), and the balance is Fe and unavoidable impurities, and of a microstructure in which ferrite has an average crystal grain diameter d of 8 to 18 μm at a ¼ thickness position of the sheet, and a ds/d ratio of 0.40 to 1.20, where ds is the average crystal grain diameter of ferrite in a steel sheet surface layer, the steel sheet having a tensile strength of 340 to 380 MPa, a bake hardenability BH of 20 to 60 MPa, and an r value of 1.4 or more, $$-10 \leq ([\%\ C]-([\%\ Nb]/93)\times 12)\times 10{,}000 \leq 14, \qquad \text{Formula (1)}$$

wherein [% C] and [% Nb] represent the C and Nb contents, respectively.

2. The steel sheet according to claim 1, wherein the composition further comprises, in mass %, at least one selected from Group A and B, Group A: at least one of V: 0.1% or less, W: 0.1% or less, Zr: 0.03% or less, Mo: 0.15% or less, and Cr: 0.15% or less; and Group B: at least one of Sn: 0.1% or less, Cu: 0.2% or less, Ni: 0.2% or less, Ca: 0.01% or less, Ce: 0.01% or less, La: 0.01% or less, and Mg: 0.01% or less.

3. A plated steel sheet comprising a plating layer on a surface of the steel sheet of claim 1.

4. A plated steel sheet comprising a plating layer on a surface of the steel sheet of claim 2.

5. A method for producing a hot-rolled steel sheet, the method comprising:

heating a steel slab of the composition of claim 1;

hot rolling the steel slab with a cumulative rolling reduction ratio of 50% or more in a temperature region of 1,000° C. or less, a finish rolling entry-side temperature of 1,080° C. or less, and a finish rolling exit-side temperature of more than 850° C. and less than 910° C.;

cooling to 720 to 800° C. at an average cooling rate of 20° C./sec or more;

retaining for 5 seconds or more in the temperature region of 720 to 800° C.; and coiling at a coiling temperature of 580 to 680° C.

6. A method for producing a cold-rolled full-hard steel sheet, the method comprising cold rolling the hot-rolled steel sheet obtained by the method of claim 5, the hot-rolled steel sheet being cold rolled at a rolling reduction ratio of 60 to 95%.

7. A method for producing a hot-rolled steel sheet, the method comprising:

heating a steel slab of the composition of claim 2;

hot rolling the steel slab with a cumulative rolling reduction ratio of 50% or more in a temperature region of 1,000° C. or less, a finish rolling entry-side temperature of 1,080° C. or less, and a finish rolling exit-side temperature of more than 850° C. and less than 910° C.;

cooling to 720 to 800° C. at an average cooling rate of 20° C./sec or more;

retaining for 5 seconds or more in the temperature region of 720 to 800° C.; and coiling at a coiling temperature of 580 to 680° C.

8. A method for producing a cold-rolled full-hard steel sheet, the method comprising cold rolling the hot-rolled steel sheet obtained by the method of claim 7 the hot-rolled steel sheet being cold rolled at a rolling reduction ratio of 60 to 95%.

9. A method for producing a steel sheet according to claim 1, the method comprising:

heating a steel slab of the composition of claim 1;

hot rolling the steel slab with a cumulative rolling reduction ratio of 50% or more in a temperature region of 1,000° C. or less, a finish rolling entry-side temperature of 1,080° C. or less, and a finish rolling exit-side temperature of more than 850° C. and less than 910° C.;

cooling to 720 to 800° C. at an average cooling rate of 20° C./sec or more;

retaining for 5 seconds or more in the temperature region of 720 to 800° C.;

coiling at a coiling temperature of 580 to 680° C. to produce a hot-rolled steel sheet;

cold rolling the hot-rolled steel sheet to obtain a cold-rolled full-hard steel sheet, the hot-rolled steel sheet being cold rolled at a rolling reduction ratio of 60 to 95%; and annealing in which the cold-rolled full-hard steel sheet is heated at an average heating rate of 1 to 8° C./sec in a temperature region of 660 to 760° C., and soaked at an annealing temperature of 760° C. to 830° C. for 30 to 240 seconds with a dew point in a temperature region of 760° C. or more set to −30° C. or less.

10. A method for producing a plated steel sheet, the method comprising plating the steel sheet obtained by the method of claim 9.

11. A method for producing a steel sheet according to claim 2, the method comprising:

heating a steel slab of the composition of claim 2;

hot rolling the steel slab with a cumulative rolling reduction ratio of 50% or more in a temperature region of 1,000° C. or less, a finish rolling entry-side temperature of 1,080° C. or less, and a finish rolling exit-side temperature of more than 850° C. and less than 910° C.;

cooling to 720 to 800° C. at an average cooling rate of 20° C./sec or more;

retaining for 5 seconds or more in the temperature region of 720 to 800° C.;

coiling at a coiling temperature of 580 to 680° C. to produce a hot-rolled steel sheet;

cold rolling the hot-rolled steel sheet to obtain a cold-rolled full-hard steel sheet, the hot-rolled steel sheet being cold rolled at a rolling reduction ratio of 60 to 95%; and annealing in which the cold-rolled full-hard steel sheet is heated at an average heating rate of 1 to 8° C./sec in a temperature region of 660 to 760° C., and soaked at an annealing temperature of 760° C. to 830° C. for 30 to 240 seconds with a dew point in a temperature region of 760° C. or more set to −30° C. or less.

12. A method for producing a plated steel sheet, the method comprising plating the steel sheet obtained by the method of claim 11.

* * * * *